US005452875A

United States Patent [19]

Kern

[11] Patent Number: 5,452,875

[45] Date of Patent: Sep. 26, 1995

[54] PLASTIC SUPPORT ASSEMBLY

[75] Inventor: David A. Kern, Albany, Oreg.

[73] Assignee: Discovery Plastics, Inc., Tangent, Oreg.

[21] Appl. No.: 230,965

[22] Filed: Apr. 21, 1994

[51] Int. Cl.[6] ..... A47G 29/02

[52] U.S. Cl. ..... 248/242; 108/108; 248/250; 248/291.1

[58] Field of Search ..... 248/242, 241, 248/247, 248, 250, 235, 222.2, 291; 108/108; 211/90

[56] References Cited

U.S. PATENT DOCUMENTS

| | | | |
|---|---|---|---|
| 473,919 | 5/1892 | Edsall | 248/291 |
| 576,769 | 2/1897 | Williams | 248/291 X |
| 3,550,891 | 12/1970 | Scott | 248/242 |
| 3,561,713 | 2/1971 | Berkowitz | 248/242 |
| 3,572,626 | 3/1971 | Bertschi | 248/242 |
| 4,018,167 | 4/1977 | Spangler | 248/250 X |
| 4,555,082 | 11/1985 | Sack et al. | 248/247 X |
| 4,944,416 | 7/1990 | Petersen et al. | 211/87 |
| 5,083,514 | 1/1992 | Schwartz et al. | 108/108 X |

FOREIGN PATENT DOCUMENTS

| | | | |
|---|---|---|---|
| 1110418 | 2/1956 | France | 248/241 |

OTHER PUBLICATIONS

Molded Economic Display Accesories Catalog p. 25 showing polycarbonate slatwall shelf bracket.

Catalog p. A–5 showing adjustable slant bracket N 768.

*Primary Examiner*—Ramon O. Ramirez

*Attorney, Agent, or Firm*—Laff, Whitesel, Conte & Saret, Ltd.

[57] ABSTRACT

A bracket assembly for securance to a wall structure. The bracket assembly has a first support element and a second bracket element releasably secured to the support element. The support and bracket elements have interdigitated sets of teeth for clamping the support and bracket elements in a selected one of plural clamped positions.

5 Claims, 2 Drawing Sheets

PLASTIC SUPPORT ASSEMBLY

BACKGROUND OF THE INVENTION

A wide variety of bracket assemblies have been developed for retail display use and the like. Such brackets typically have ears for mounting the brackets on metal posts or standards, and have sometimes been formed of two parts, in which separate bracket and mounting elements have been provided for releasable adjustment of the angle at which the bracket projects forwardly from a support structure such as a metal standard.

In addition to such bracket and standard constructions, mounting plates for supporting brackets from so-called slatwall constructions, one of which is typically shown in U.S. Pat. No. 4,944,416, are known. In such constructions, rather than using the ears of typical brackets, a plate with a hook at its top for capture in a shaped groove in a slatwall panel is used to suspend the bracket or other supporting element. In some instances the use of plastic brackets have been suggested.

It would be desirable to provide an improved plastic bracket and similar structures for mounting on a slatwall panel.

SUMMARY OF THE INVENTION

In accordance with the present invention an adjustable, two part plastic support assembly is provided.

The support assembly is adapted for securance to a wall structure, and comprises a first support element having means for mounting the support assembly to a wall structure, and a second support element releasably secured to the first support element and projecting forwardly therefrom.

A first plurality of locking elements is formed with the first support element. The locking elements are disposed along radii having a common center. A second plurality of locking elements are formed with the second support element and are disposed along radii having a second common center. The first and second locking elements are positioned in a complementary and interdigitated array to provide a plurality of positions in which the second support element may be releasably secured to the first support element and to provide a plurality of spaced load bearing pairs of surfaces to resist movement of the second support element relative to the first support element when the second support element is loaded. Means for clamping the first and second locking elements in the interdigitated array are also present.

In a preferred form first locking elements comprise a first set of teeth and the second locking elements comprise a second set of teeth interdigitated with the first set of teeth. The tooth sets of each of the first and second support elements have apices which lie along the surfaces of cones. In another form the tooth sets of each of the first and second support elements have apices which lie along the surfaces of flat planes.

Preferably the tooth sets of each of the first and second support elements lie in a circular array and one of the sets is circumscribed by a collar which, when teeth are interdigitated, resist movement of the teeth out of the interdigitated array.

The second support element may be a bracket which projects forwardly from the first support element, and the first and second locking elements may comprise, respectively, first and second sets of teeth which lie in circular arrays. The first support element may be a support plate having an upper hook element for mounting the support assembly to a slatwall structure.

Further objects, features and advantages of the present invention will become apparent from the following description and drawings.

DETAILED DESCRIPTION OF THE PRESENTLY PREFERRED EMBODIMENTS

Figure 1:
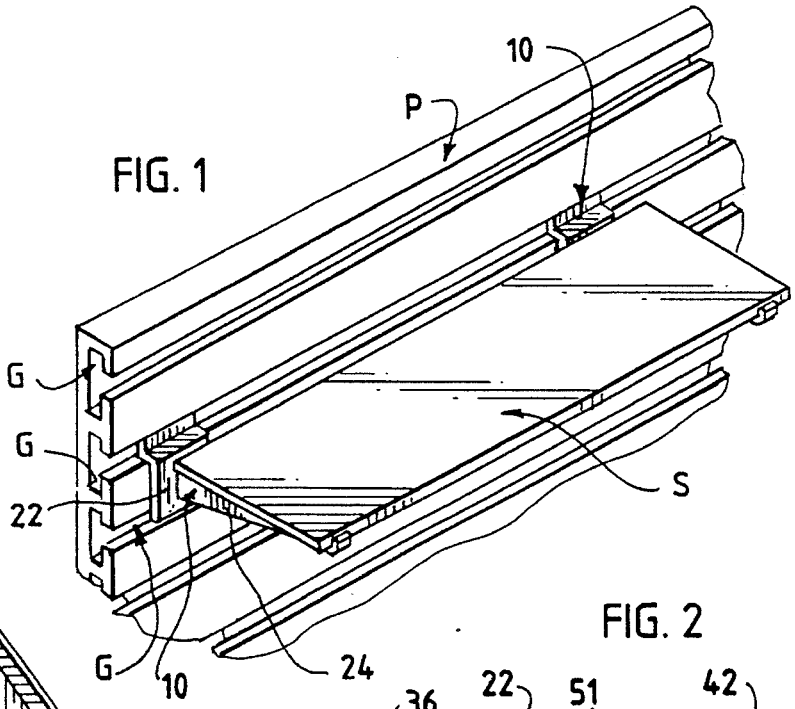
FIG. 1 is a front perspective view of a slatwall wall structure from which a pair of support assemblies in accordance with the present invention project to support a shelf.
Figure 3:
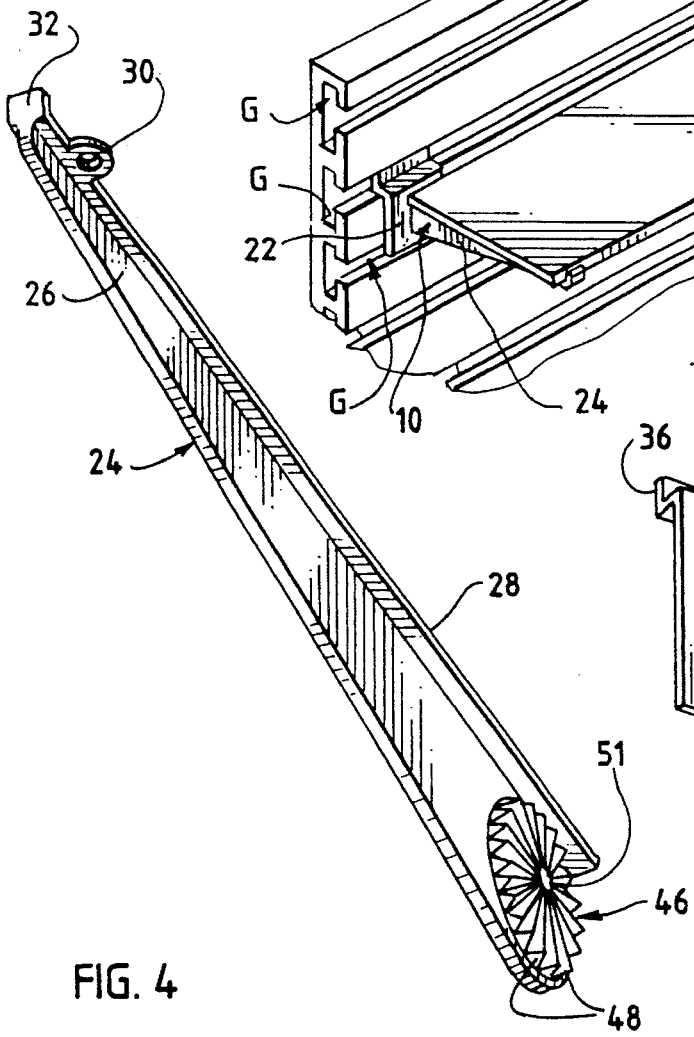
FIG. 3 is a perspective view of a further portion of the support assembly of FIG. 1.
Figure 2:
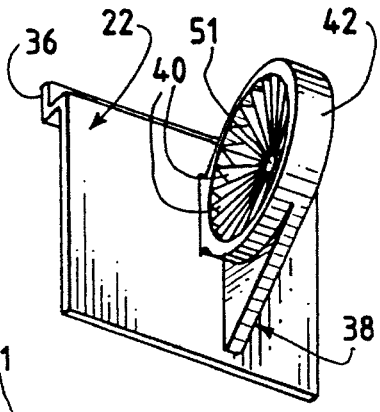
FIG. 2 is a perspective view of a portion of the support assembly of FIG. 1.
Figure 4:
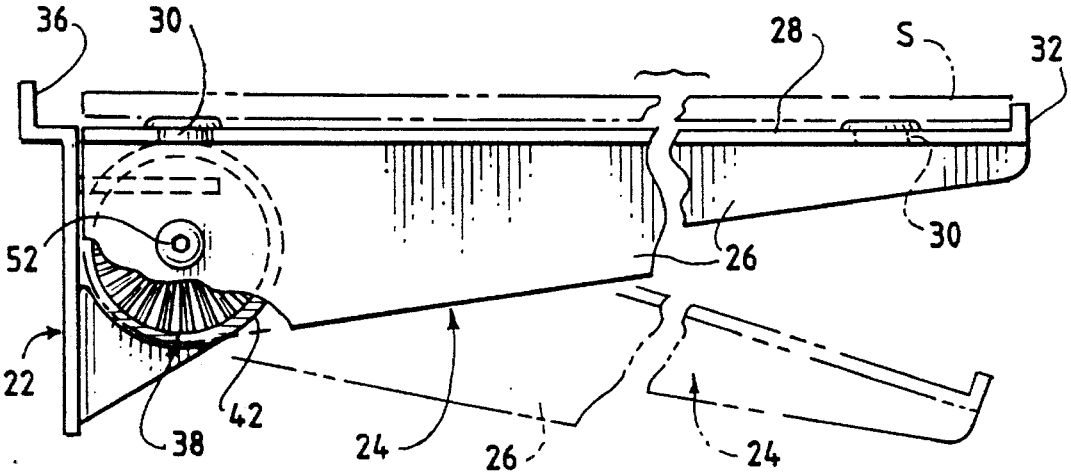
FIG. 4 is a view of the portions of FIGS. 2 and 3 in assembled condition.
Figure 5:
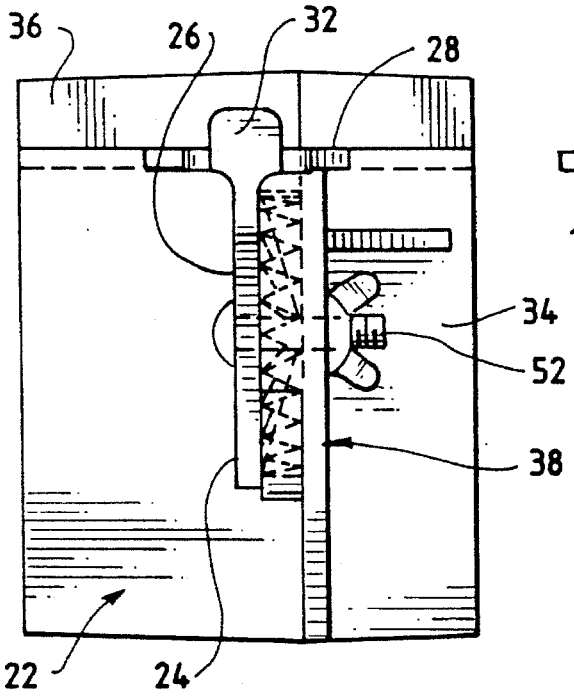
FIG. 5 is a front elevational view of FIG. 4.

Referring now to the drawings, a slatwall display panel P is shown in FIG. 1. Panel P may be formed of wood composite material, such as hardboard, which is relatively inexpensive and relatively strong and stable. Such slatwall display panels are available from a variety of sources and may be suitably finished for the particular environment in which they are to be used, such as in retail stores.

The slatwall display panel P has a series of spaced horizontal grooves G. Each groove G has a narrow entryway and an upper groove portion and a lower groove portion which are recessed and which receive the mounting portions of support assemblies.

The support structure in the embodiment shown includes a pair of support assemblies 10. Each assembly includes a pair of support elements, including a back or mounting plate 22 and a bracket 24. Each is preferably integrally molded of a suitable plastic, such as polycarbonate. Bracket 24 typically comprises a forwardly extending blade 26 and an upper, generally horizontal support surface 28. Support surface 28 is proportioned to support a shelf S on the surface 28. Shelf S, if wood or the like, may be secured to the bracket via screws which are adapted to cooperate with eyes 30. Alternatively, eyes 30 may be fitted with resilient bumpers or the like to support glass shelves. The forward end of blade 26 a hook 32 is provided to act as a stop against movement of the shelf forwardly.

Mounting plate 22 as shown includes a back plate 34 and an upwardly extending mounting hook 36.

Referring now to FIG. 1, it may be seen that back plate 34 is integrally formed with a forwardly projecting securing member 38 which has a sidewardly facing series of locking elements comprising a first set of teeth 40. Teeth 40 are disposed in a circular array. Each tooth lies along a radius. All of the radii have a common center. The apices of the teeth lie along the surface of shallow cone. In one embodiment, as shown, the teeth may be twenty-four in number, i.e., there is a tooth every fifteen degrees along the circumference of the circular array. The teeth 40 are circumscribed by a collar 42.

The blade of bracket 24 provides a complementary, laterally facing, securing member 46 which comprises a complementary plurality of teeth, also arranged in a circular array, with each of the teeth lying along radii having a common center. The teeth 48 are twenty-four in number and are arrayed in a manner similar to teeth 40 of mounting plate 22. Teeth 48 project radially outwardly so that when they are interdigitated with the teeth 40 to form an interdigitated array, they lie within the collar 42. As such, collar 42 serves to surround teeth 48 and to resist movement of the set of teeth 48 out of the interdigitated array.

The bracket 24 and mounting plate 22 are secured to each other via a fastener such as a threaded nut and bolt 52 which extends through openings 51 to clamp and retain the securing members 38, 46 in an interdigitated array, and to secure them to each other. When the fastener 52 is released, it will be apparent that the angle at which the bracket 24 projects forwardly from the mounting plate 22 may be changed so that a shelf S can be disposed in at any one of a predetermined number of angular relationships to the horizontal.

It will be apparent from the foregoing that each of the interdigitated pairs of teeth 40, 48 provides mating load bearing surfaces which help support the shelf (and what is supported on the shelf). If desired, fewer teeth 40 may be used, and the number of teeth on the mounting plate and bracket need not be the same as long as they are angularly disposed in a suitably complementary fashion and their spacing is such that they may be interdigitated.

Thus, it will be apparent from the drawings, that easily molded plastic parts may be made to form a pair of complementary support elements which may be conveniently mounted on a wall structure and which may easily be secured to each other in a variety of desired display positions. It will also be apparent that other pairs of support elements than a mounting plate and a bracket may be provided with complementary locking elements in accordance with the present invention to provide the advantages just described. So it is clear that the improved means for providing adjustability is not restricted to use with a bracket structure.

Figure 6:
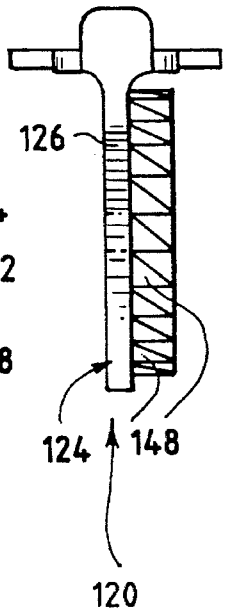
FIG. 6 illustrates an alternative configuration and arrangement of a portion of a support assembly of this invention.
Figure 7:
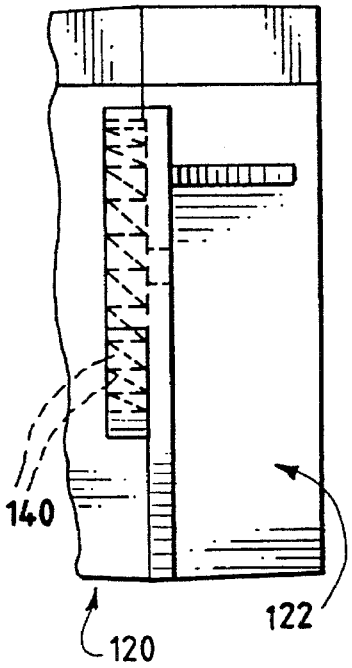
FIG. 7 is a view of a further complementary portion of the support assembly of FIG. 6 adapted to be assembled in a relationship like that shown in FIG. 5.

Another embodiment of the present invention is shown in FIGS. 6 and 7. As there seen, a support assembly 120 having a mounting plate 122 and a bracket 124 are provided. In this instance, each of those elements provides securing elements including teeth. Teeth 148 (on the brackets 124) and teeth 140 (on the mounting plate 122) are similarly complimentarily arranged and arrayed. The teeth themselves are formed with one surface which lies in a plane which is perpendicular to the plane of the blade 126, rather than having the surfaces of each tooth surface lying in planes which are inclined to the plane of the blade. Additionally, the apices of the teeth of each set of teeth are arranged to lie in a common flat plane, rather than lying on the surface of a shallow cone as was the case with the embodiment of FIG. 1–4.

Figure 8:
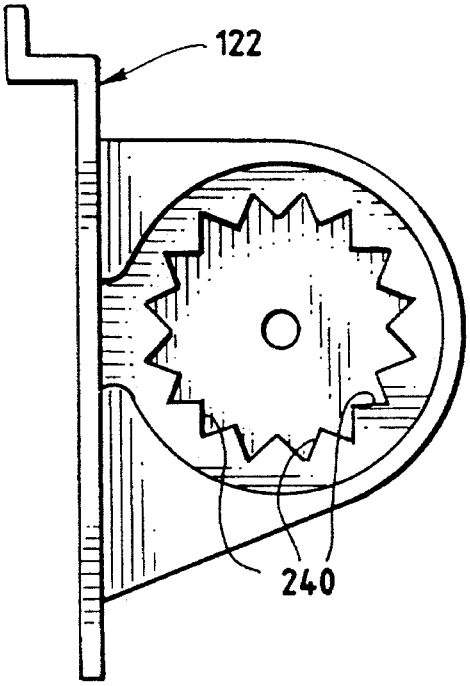
FIGS. 8 and 9 illustrate locking portions of yet another embodiment of a support assembly of the present invention.
Figure 9:
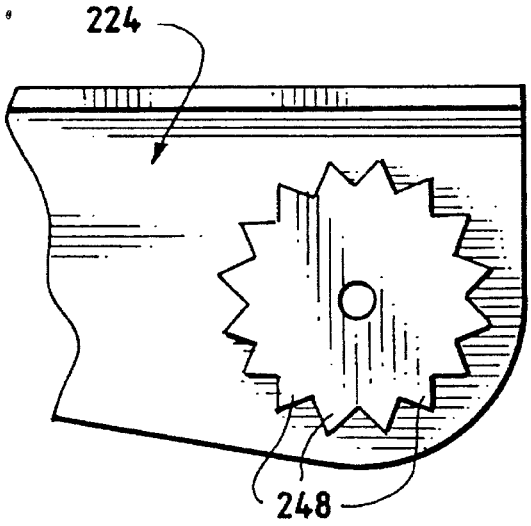

Referring now to FIGS. 8 and 9, again the mounting plate 222 and bracket 224 may be similar to those already shown. However in this instance, the teeth of the securing members are arrayed somewhat differently. Thus each tooth 240 lies along a radius having a common center. However, the teeth are disposed in a circular, circumferentially positioned array much in the manner of a gear. Teeth 248 are arrayed in a complementary fashion and nest snugly within teeth 240. When the teeth are separated laterally, the angular relationship of the two may be altered. They are then renested and preferably locked together with a fastener like fastener 52 to retain the nested relationship.

While particular embodiments of the invention have been shown and described, it will be obvious to those skilled in the art that changes and modifications may be made without departing from the spirit and scope of the invention. As such, the invention is not to be considered as being limited except as may be made necessary by the claims.

What is claimed is:

1. A plastic support assembly for securance to a wall structure, said support assembly comprising a first support element comprising a support plate having an upper hook means for mounting said support assembly to a wall structure, and a second support element releasably secured to said first support element projecting forwardly therefrom;

a first plurality of locking elements comprising a first tooth set formed with said first support element, said locking elements being disposed along radii having a common center and being disposed in a circular array, a second plurality of locking elements comprising a second tooth set formed with said second support element, said locking elements being disposed along radii having a second common center and being disposed in a circular array, said first and second tooth sets being positioned in a complementary, concentric and interdigitated array to provide a plurality of positions in which said second support element may be releasably secured to said first support element and to provide a plurality of spaced load bearing pairs of surfaces to resist movement of said second support element relative to said first support element when said second support element is loaded; and means for clamping said first and second tooth sets in said interdigitated array.

2. A support assembly in accordance with claim 1, and wherein said second support element is a bracket which projects forwardly from said first support element.

3. A support assembly for securance to a wall structure, said support assembly comprising a first support element having means for mounting said support assembly to a wall structure, and a second support element releasably secured to said first support element projecting forwardly therefrom;

a first plurality of locking elements comprising a first set of teeth formed with said first support element, said locking elements being disposed along radii having a common center, a second plurality of locking elements comprising a second set of teeth formed with said second support element, said locking elements being disposed along radii having a second common center, said first and second sets of teeth being positioned in a complementary and interdigitated array to provide a plurality of positions in which said second support element may be releasably secured to said first support element and to provide a plurality of spaced load bearing pairs of surfaces to resist movement of said second support element relative to said first support element when said second support element is loaded, and wherein the tooth sets of each of said first and second support elements lie in a circular array and one of the sets is circumscribed by a collar which, when teeth are interdigitated, resist movement of said teeth out of said interdigitated array, and means for clamping said first and second locking elements in said interdigitated array.

4. A support assembly for securance to a wall structure, said support assembly comprising a first support element having means for mounting said support assembly to a wall structure, and a second support element releasably secured to said first support element projecting forwardly therefrom;

a first plurality of locking elements formed with said first support element, said locking elements being disposed along radii having a common center, a second plurality of locking elements formed with said second support element, said locking elements being disposed along radii having a second common center, said first and second locking elements being positioned in a complementary and interdigitated array to provide a plurality of positions in which said second support element may be releasably secured to said first support element and to provide a plurality of spaced load bearing pairs of surfaces to resist movement of said second support element relative to said first support element when said second support element is loaded;

means for clamping said first and second locking elements in said interdigitated array;

and wherein said second support element is a bracket which projects forwardly from said first support element, and said first and second locking elements comprise, respectively, first and second sets of teeth which lie in circular arrays, one of said sets of teeth being circumscribed by a collar which surrounds said other set of teeth to resist movement of said other set of said interdigitated array.

5. A support assembly in accordance with claim 4, and wherein said first support element is a support plate having an upper hook element for mounting said support assembly to a slatwall structure.

* * * * *